US008603722B2

(12) United States Patent
Itou et al.

(10) Patent No.: US 8,603,722 B2
(45) Date of Patent: Dec. 10, 2013

(54) TONER PRODUCING METHOD AND TONER

(75) Inventors: Tsuyoshi Itou, Shizuoka-ken (JP); Takayasu Aoki, Shizuoka-ken (JP); Koji Imamiya, Kanagawa-ken (JP); Masahiro Ikuta, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 208 days.

(21) Appl. No.: 13/086,661

(22) Filed: Apr. 14, 2011

(65) Prior Publication Data

US 2011/0262850 A1 Oct. 27, 2011

Related U.S. Application Data

(60) Provisional application No. 61/328,378, filed on Apr. 27, 2010.

(51) Int. Cl.
*G03G 9/09* (2006.01)

(52) U.S. Cl.
USPC ..... 430/137.14

(58) Field of Classification Search
USPC ..... 430/137.14
See application file for complete search history.

(56) References Cited

U.S. PATENT DOCUMENTS

2007/0020554 A1* 1/2007 Chen et al. ..... 430/137.14
2010/0209839 A1* 8/2010 Kabai et al. ..... 430/110.2

* cited by examiner

*Primary Examiner* — Peter Vajda
(74) *Attorney, Agent, or Firm* — Turocy & Watson, LLP

(57) ABSTRACT

There is provided a method for producing a toner that includes encapsulated erasable colored fine particles aggregated with fine particles that contain at least a binder resin and a release agent. The method includes: mixing a dispersion of erasable fine particles with an aggregating agent to form an aggregating agent-containing colored fine particle dispersion; and mixing the aggregating agent-containing colored fine particle dispersion with a fine particle dispersion that contains at least a binder resin and a release agent, so as to aggregate the aggregating agent-containing colored fine particles with the fine particles that contain at least a binder resin and a release agent. In this way, the encapsulated colored fine particles are prevented from being released from the resultant toner particles, and an erasable toner can be obtained that has a narrow particle size distribution and that produces less fogging.

7 Claims, 1 Drawing Sheet

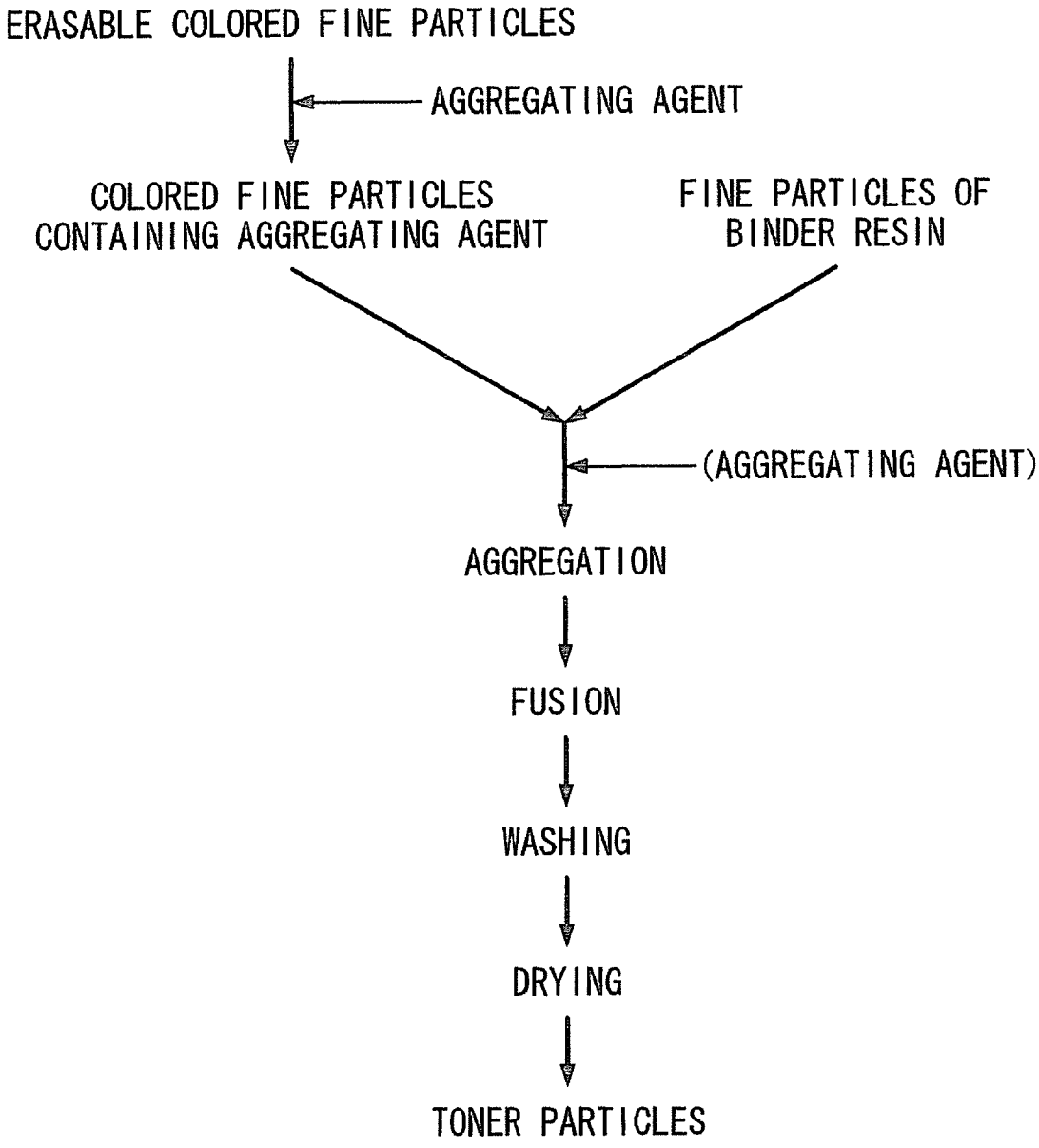
ERASABLE COLORED FINE PARTICLES
AGGREGATING AGENT
COLORED FINE PARTICLES CONTAINING AGGREGATING AGENT
FINE PARTICLES OF BINDER RESIN
(AGGREGATING AGENT)
AGGREGATION
FUSION
WASHING
DRYING
TONER PARTICLES

TONER PRODUCING METHOD AND TONER

CROSS-REFERENCE TO RELATED APPLICATION

This application is based upon and claims the benefit of priority from: U.S. provisional application 61/328,378, filed on Apr. 27, 2010, the entire contents of which are incorporated herein by reference.

FIELD

Embodiments described herein relate generally to methods for producing toners, particularly methods for producing erasable toners, and erasable toners thus produced.

BACKGROUND

The heat-responsive erasable toner containing a color-forming compound and a color-developing agent disclosed in U.S. Pat. No. 7,354,885 is a known example of erasable toner. In this technique, the color-forming compound and the color-developing agent are incorporated into toner by being melted and kneaded with a binder resin using a kneading and pulverization method to provide an erasable toner. The printed paper formed with the erasable toner is heated at 100 to 200° C. for about 1 to 3 hours to decolor the printed portion, and the decolored paper can be reused. By thus reducing paper consumption, the technique contributes to reducing the environmental load.

However, because the kneading and pulverization method involves high-shear kneading at high temperatures of about 100 to 200° C., the leuco dye and the color-developing agent are uniformly dispersed in the binder, resin to obstruct the reaction between the leuco dye (color-forming compound) and the color-developing agent, and lower the developed color density of the toner. Further, if the toner materials, such as a binder resin and a release agent, have a decoloring action, the color density of the toner is lowered during the kneading, thus requiring the use of toner materials having a weak decoloring action. The binder resin is particularly troublesome or problematic in this regard, because only a specific resin with no decoloring action such as styrene-butadiene resin can be used, and it is very difficult to use polyester resin or styrene acryl resin, which, despite superior fusibility, is likely to exert decoloring action.

Instead of the kneading and pulverization method, the present inventors have proposed a "wet" method, in which erasable colored fine particles, and binder resin or other fine particles are aggregated and fused in an aqueous medium to produce a toner (US2010/209839A1). Because this method aggregates the fine particles, a toner of a small particle diameter can be produced, and the shape of the particles can be varied from the potato shape to spherical by varying the conditions of the fusing heat treatment. Further, erasable fine particles can be produced as a mixture with the binder resin, without application of mechanical shear or high heat history according to melting and kneading. For example, a toner can be produced at relatively low temperatures of below 80° C. and above the Tg of the binder resin. The method is therefore effective for toners comprising encapsulated erasable colored fine particles, or for toners that are erased irreversibly by heat history.

However, it is very difficult to fully incorporate the encapsulated erasable fine particles into the toner, because such fine particles have a very high dispersion stability. As a result, fine particles of the toner are liable to be increased to deteriorate the image quality.

BRIEF DESCRIPTION OF THE DRAWING

FIG. 1 is a flowchart representing toner production according to an embodiment of the present invention.

DETAILED DESCRIPTION

The present invention overcomes the foregoing problems, and realizes toner production that prevents generation of fine particles caused by the separation of encapsulated erasable colored fine particles from the toner.

In an aspect of the present invention, the encapsulated erasable colored fine particles are treated with an aggregating agent in advance to lower the dispersion stability thereof, then mixed with a binder resin and other components, and aggregated to produce toner.

An embodiment of the present invention is described below. In the following descriptions, the "part(s)" and "%" representing compositions are part and percent by weight unless otherwise stated specifically.

According to an embodiment of the present invention, there is provided a method for producing a toner, including: mixing a dispersion of erasable fine particles with an aggregating agent to form an aggregating agent-containing colored fine particle dispersion; and mixing the aggregating agent-containing colored fine particle dispersion with a dispersion of fine particles comprising at least a binder resin and a release agent, thereby aggregating the aggregating agent-containing colored fine particles with the fine particles comprising at least a binder resin and a release agent. According to this method, the aggregatability of the encapsulated colored fine particles can be improved, and the dispersion stability of individual particles can be lowered to enable the encapsulated colored fine particles to be stably incorporated into the toner.

More specifically, FIG. 1 represents a production flowchart according to an embodiment of the invention.

A dispersion of encapsulated erasable colored fine particles is obtained first, and then mixed with an aggregating agent aqueous solution to obtain an aggregating agent-containing color dispersion.

The encapsulated erasable colored fine particles, specifically, the core components of the encapsulated erasable colored fine particles include at least a leuco dye, a color-developing agent, and a decoloring agent. Preferably, the decoloring agent is one having a temperature hysteresis. With these components, a toner can be obtained that can be erased instantaneously.

The leuco dye is an electron-donating compound that can form color with the color-developing agent. Examples of the leuco dye include diphenylmethane phthalides, phenylindolyl phthalides, indolyl phthalides, diphenylmethane azaphthalides, phenylindolylazaphthalides, fluorans, styrylquinolines, and diazarhodamine lactones. These may be used as a mixture of two or more species.

The color-developing agent used in the present invention is an electron-accepting compound that donates a proton to the leuco dye. Examples of the color-developing agent include phenols, phenol metal salts, carboxylic acid metal salts, aromatic carboxylic acids, aliphatic carboxylic acids of 2 to 5 carbon atoms, benzophenones, sulfonic acids, sulfonates, phosphoric acids, phosphoric acid metal salts, acidic phosphoric acid esters, acidic phosphoric acid ester metal salts, phosphorous acids, phosphorous acid metal salts, monophenols, polyphenols, 1, 2, 3-triazole, and derivatives thereof, including unsubstituted or substituted with substituents such as an alkyl group, an aryl group, an acyl group, an alkoxycarbonyl group, a carboxy group and esters thereof, an amide group, and a halogen group. Other examples include bis-, tris-phenols, phenol-aldehyde condensate resins, and metal salts of these. These may be used as a mixture of two or more species.

It is preferred that the color-developing agent be used in a proportion of 0.5 to 10 parts, particularly 1 to 5 parts with respect to 1 part of the leuco dye. Less than 0.5 part, the color density decreases. Above 10 parts, complete decoloration becomes difficult.

The decoloring agent used in the present invention may be a known decoloring agent, provided that it can erase color by inhibiting the color-forming reaction between the leuco dye and the color-developing agent under heat in the three-component system of the leuco dye (color-forming compound), the color-developing agent, and the decoloring agent.

Particularly, the decoloring agents known from JP60-264285A, JP2005-1369A, and JP2008-280523A that can produce a coloring-decoloring system utilizing the temperature hysteresis of the decoloring agent have superior instantaneous erasability. The color of the three-component mixture can be erased by heating the mixture to a temperature equal to or greater than a specific decoloration temperature Th. The decolored state can be maintained even after the decolored mixture is cooled down to a temperature below Th. Upon lowering the temperature further, a reversible coloring-decoloring reaction can take place, whereby the color-forming reaction between the leuco dye and the color-developing agent is caused again at or below a specific color restoration temperature Tc to return to the colored state. The decoloring agent used in the present invention may preferably satisfy the relation Th>Tr>Tc, where Tr is room temperature.

Examples of decoloring agents that can exhibit such temperature hysteresis include alcohols, esters, ketones, ethers, and acid amides.

Of these, esters are particularly preferred. Specific examples thereof include carboxylic acid esters that contain a substituted aromatic ring; esters of unsubstituted aromatic ring-containing carboxylic acid and aliphatic alcohol; carboxylic acid esters that contain a cyclohexyl group within the molecule; esters of fatty acid and unsubstituted aromatic alcohol or phenol; esters of fatty acid and branched aliphatic alcohol; esters of dicarboxylic acid and aromatic alcohol or branched aliphatic alcohol; dibenzyl cinnamate; heptyl stearate; didecyl adipate; dilauryl adipate; dimyristyl adipate; dicetyl adipate; distearyl adipate; trilaurin; trimyristin; tristearin; dimyristin; and distearin. These may be used as a mixture of two or more.

It is preferable that the decoloring agent be used in a proportion of 1 to 500 parts, particularly 4 to 99 parts with respect to 1 part of the leuco dye. Less than 1 part, the development of a fully decolored state is difficult. Above 500 parts, the color density may lower.

The core components of the coloring agent fine particles, including the leuco dye, the color-developing agent, and the decoloring agent may be encapsulated using, for example, an interfacial polymerization method, a coacervation method, an in-situ polymerization method, a drying-in-liquid method, and a curing-and-coating-in-liquid method.

The in-situ polymerization method that uses a melamine resin as a shell component, and the interfacial polymerization method that uses a urethane resin as a shell component are particularly preferred.

In the in-situ polymerization method, the three components are dissolved and mixed, and emulsified in an aqueous solution of a water-soluble polymer or a surfactant. These components can then be encapsulated by addition and heat polymerization of a melamine formalin prepolymer aqueous solution.

In the interfacial polymerization method, the three components and a polyvalent isocyanate prepolymer are dissolved and mixed, and emulsified in an aqueous solution of a water-soluble polymer or a surfactant. The components can, then be encapsulated by heat polymerization with addition of a polyvalent base such as diamine and diol.

In any case, an aqueous dispersion of encapsulated colored fine particles is obtained that has a sharp particle distribution with a volume-average particle diameter of 0.5 to 3.5 μm, preferably 1.0 to 3.0 μm, as measured by a laser method. In the erasable colored fine particles encapsulated in this manner, the colored fine particle-forming three components, that is the leuco dye (color-forming compound), the color-developing agent, and the decoloring agent, can closely coexist in the capsules without the binder resin being intervened, and a coloring-decoloring system can be created so as to allow quick transformation between a high-density colored state and a decolored state.

In case where the colored fine particles contain a decoloring agent having a temperature hysteresis, the colored fine particles are generally colorless in this state, so that the colored fine particles are, once collected from the aqueous dispersion, as required, and cooled to a temperature equal to or less than the color restoring temperature Tc to produce the colored state before proceeding to the next step.

The encapsulated colored fine particles are then dispersed again as required in water with a surfactant, and an aggregating agent is added to the aqueous dispersion to obtain an aggregating agent-containing colored fine particle dispersion, according to the present invention. The solid content (encapsulated colored fine particles) in the aqueous dispersion at this stage is preferably from 10 to 50%, particularly from 20 to 30%. The aggregating agent may be added while heating the aqueous dispersion to 50° C. to 70° C. Because the encapsulated colored fine particles have very high dispersion stability, it is preferable to use an aggregating agent that has a strong aggregation-promoting force. Preferred examples of aggregating agent include bivalent or higher metal salts, i.e., salts of metals having a valence of two or more. Specific examples include bivalent metal salts such as magnesium chloride, calcium chloride, magnesium sulfate, calcium nitride, zinc chloride, ferric chloride, and ferric sulfate, and trivalent metal salts such as aluminum sulfate and aluminum chloride. Preferably, the aggregating agent is used in a proportion of 0.01 to 1 part, particularly 0.1 to 0.7 part with respect to 1 part of the colored fine particles. If an identical aggregating agent is used, it is preferred that the relative amount of the aggregating agent with respect to the colored fine particles in the aggregating agent-containing colored fine particle dispersion is at least two times the relative amount of the aggregating agent with respect to toner components (i.e. components to be aggregated) in the mixture of the aggregating agent-containing colored fine particle dispersion and a dispersion of fine particles comprising at least a binder resin and a release agent (described later).

The aggregating agent is added to lower the releasability (dispersion stability) of the encapsulated colored fine particles in a mixture with other toner components such as a binder resin in subsequent steps. Thus, it is not necessarily required to aggregate the colored fine particles in the aggregating agent-containing colored fine particle dispersion. Further, as required, an excess of the aggregating agent can be removed by solid-liquid separation, which may be performed by collecting the encapsulated colored fine particles from the aqueous dispersion after the addition of the aggregating agent, or by removing the water dispersion liquid phase.

The aggregating agent-containing colored fine particle dispersion is then mixed with fine particles comprising a binder resin and a release agent.

The binder resin may be those commonly used as toner binders, including styrene resins such as polyester resin, polystyrene, styrene-butadiene copolymer, and styrene-acryl copolymer. The binder resin preferably has a glass transition point of 40 to 80° C., and a softening point of 80 to 180° C., and gives a fixing temperature of generally 50 to 200° C., preferably 50 to 150° C., either alone or with the below-mentioned release agent used together as required. Polyester resin having a good fixability is particularly preferable as the binder resin. Preferably, the polyester resin has an acid number of 1 (mg KOH/g) or more. With such an acid number, the polyester resin can exhibit the alkaline pH adjuster effect in the fine particle formation, and color particles of a small particle diameter can be obtained.

For the purpose of adjusting fixing temperature and ease of release, common release agents, for example, aliphatic hydrocarbon waxes, oxides of aliphatic hydrocarbon waxes or block copolymers of these, plant waxes, animal waxes, mineral waxes, and waxes that contain fatty acid ester as the main component are used as the release agent.

Preferably, the binder resin and the release agent are used in a combined amount of 1 to 99 parts, particularly 2 to 19 parts with respect to 1 part of the encapsulated colored fine particles.

A charge control agent, for example, such as a metal-containing azo compound and a metal-containing salicylic acid derivative compound is also added, as required, to the fine particles comprising the binder resin as the main component.

The fine particles comprising components such as the binder resin, the release agent, and the charge control agent can be formed by using the methods described in US2010/209839A1 (of which the disclosure is incorporated herein by reference), including a method in which the components are melted and mixed, and optionally comminuted before being ejected from a high-pressure pump through a nozzle to form the fine particles, and an emulsion polymerization method.

The fine particles comprising the binder resin as a main component can be mixed by directly charging them into the aggregating agent-containing colored fine particle dispersion. However, it is more preferable to mix the fine particles comprising the binder resin with the aggregating agent-containing colored fine particle dispersion after separately dispersing the fine particles comprising the binder resin in an aqueous solution containing a surfactant.

As required, an additional aggregating agent is added to the mixture to aggregate the fine particles. The same bivalent or higher metal salts used for the formation of the aggregating agent-containing colored fine particle dispersion are preferably used as such additional aggregating agents. However, the aggregating agents are not necessarily required to be the same. The amount of the aggregating agent in the dispersion system that occurs as a result of mixing is preferably about 0.001 to 0.5 part, particularly about 0.01 to 0.2 part with respect to 1 part of the toner components.

The temperature of the dispersion system during the aggregation is set to about 25 to 80° C., and the system temperature is then gradually elevated to a temperature of from the binder resin to about 100° C., desirably under stirring, for promoting the fusion of the aggregated particles after adding a fusion stabilizer such as a polycarboxylic acid sodium salt aqueous solution for the purpose of preventing excessive aggregation of the particles.

Thereafter, the aggregated and fused particles are washed with water and dried, and an external additive, such as silica and titanium oxide, with a particle diameter of from about 10 to about 100 nm is added to obtain a toner having a volume-average diameter of from 4 to 15 μm, and a 50% number-average diameter of 4 to 15 μm based on a particle size distribution determined by using a Coulter method (the lower limit of measurable diameter with a 100-μm aperture: 2.0 μm). The toner produced according to the method of the present invention contains few free fine particles, and thus the 50% number-average diameter is close to the volume-average particle diameter thereof. The particle size distribution is therefore narrow, as represented by a small coefficient of variation CV (=standard deviation/50% number-average diameter×100) of at most 40, preferably 1t most 35%.

EXAMPLES ARE DESCRIBED BELOW

<Production of Colored Particle Dispersion>

The components including 1 part of 3-(2-ethoxy-4-diethylaminophenyl)-3-(1-ethyl-2-methylindol-3-yl)-4-azaphthalide (leuco dye), 5 parts of 2,2-bis(4-hydroxyphenyl) hexafluoropropane (color-developing agent), and 50 parts of a diester compound of pimelic acid and 2-(4-benzyloxyphenyl)ethanol (decoloring agent), were heated and dissolved. The dissolved components were then charged into 250 parts of an 8% polyvinylalcohol aqueous solution together with a mixed solution of 20 parts of aromatic polyvalent isocyanate prepolymer and 40 parts of ethyl acetate (encapsulating agent). After emulsifying and dispersing these components, the mixture was stirred at 90° C. for about 1 hour, and 2 parts of water-soluble aliphatic modified amine was added as a reactant. The mixture was further stirred for about 3 hours at the maintained liquid temperature of 90° C. to obtain colorless capsule particles. The capsule particle dispersion was then placed in a freezer at −20° C. to cause color formation, whereby a blue particle dispersion having a solid content of 24% was obtained. The color particles had a volume-average particle diameter of 2 μm, as measured by a laser method with a particle size distribution measurement device (Shimadzu Corporation; SALD7000; measurable particle diameter range of 10 nm to 300 μm). The full decoloration temperature Th was 79° C., and the full coloration temperature Tc was −10° C.

<Production of Dispersion of Fine Particles Comprising Binder Resin and Release Agent>

94 parts of polyester resin as the binder resin (glass transition point of 45° C.; softening point of 100° C.), 5 parts of rice wax as the release agent, and 1 part of a charge control agent (TN-105, made by Hodogaya Chemical Co., Ltd.) were uniformly mixed with a dry mixer, and melt-kneaded at 80° C. using a biaxial kneader (PCM-45; Ikegai Corp.). The resultant composition was pulverized with a pin mill to a size of a 2-mm mesh-pass, and further pulverized with a Bantam mill to provide an average particle diameter of 50 μm.

Thereafter, 0.9 parts of sodium dodecylbenzene-sulfonate (surfactant), 0.45 parts of dimethylamino-ethanol (pH adjuster), and 68.65 parts of de-ionized water were mixed, and 30 parts of the pulverized composition was dispersed in this aqueous solution, followed by degassing under vacuum, to obtain a dispersion.

The dispersion was then subjected to a fine particle forming process at 180° C. under 150 MPa. At the maintained temperature of 180° C., the pressure was reduced, and the temperature was lowered to 30° C. to obtain a dispersion of the binder resin and the release agent, using a high-pressure impact-type dispersion apparatus (NANO 3000, made by Beryu Co., Ltd.) equipped with a 12-m heat-exchange high-pressure pipe (heater) immersed in an oil bath, a high-pressure pipe (pressurizing section) provided with a series of 0.13-μm and 0.28-μm nozzles, a medium-pressure pipe (decompressing section) provided with a series of cells with hole diameters of 0.4, 1.0, 0.75, 1.5, and 1.01 μm, and a 12-m heat-exchange pipe (cooler) cooled with tap water. The resultant particles had a volume-average particle diameter of 0.5 μm, as measured by a laser method with a particle size distribution measurement device (SALD 7000).

Example 1

70 parts of the colored fine particle dispersion obtained above were heated to 60° C., and 30 parts of a 25% aluminum sulfate aqueous solution was gradually added while stirring the dispersion with a homogenizer (made by IKA Japan) at 6,500 rpm. The dispersion was left standing for 1 hour, and cooled down to room temperature to obtain an aggregating agent-containing colored particle dispersion. The particles had a 50% volume-average diameter Dv of 2.8 μm, as measured by a Coulter particle size distribution measurement device (Coulter Multisizer 3; 100-μm aperture; particle diameter range: 2.0 to 60 μm).

Thereafter, 2 parts of the aggregating agent-containing colored particle dispersion, 15 parts of the binder resin- and release agent-containing fine particle dispersion, and 83 parts of de-ionized water were mixed, and 5 parts of a 5% aluminum sulfate aqueous solution was added while stirring the mixture with a homogenizer (IKA) at 6,500 rpm. The mixture was then heated to 40° C. while being stirred at 800 rpm in a 1-L stirring vessel equipped with paddle blades. The mixture was left standing at 40° C. for 1 hour, and 10 parts of a 10% sodium polycarboxylate aqueous solution was added. The mixture was heated to 68° C., left standing for 1 hour, and cooled to obtain a blue toner dispersion.

The toner dispersion was repeatedly subjected to filtration and washing with de-ionized water until the conductivity of the filtrate became 50 μS/cm. The particles were then dried with a vacuum dryer to a water content of below 1.0 weight %, thereby obtaining dry particles.

After the drying, 2 parts of hydrophobic silica with a particle diameter of 30 nm, and 0.5 parts of titanium oxide with a particle diameter of 20 nm were mixed as additives with 100 parts of the dry particles so as to allow the additives to attach to the dry particle surfaces. As a result, a decolorable toner was obtained. The particles had a 50% number-average diameter Dp of 8.2 μm, as measured by the Coulter particle size distribution measurement device. The particle distribution was very sharp with a coefficient of variation CV (=standard deviation/50% number-average diameter Dp×100) of 32%.

The resultant toner was mixed with a silicone resin-coated ferrite carrier, and used for image formation in a 25° C./50% RH atmosphere using a multi-functional printer (MFP) (e-studio 4520c, made by Toshiba Tec). The resultant image exhibited no fogging. More specifically, a color image with an image density of 0.5 was obtained at the adjusted fixing temperature of 70° C. and the adjusted paper feed speed of 30 mm/sec, while no fogging as indicated by an image density of 0.05 identical to that of the white paper stock.

The de-coloring of the color image was confirmed after the color image was passed through a fixing device at a temperature of 100° C. and a paper feed speed of 100 mm/sec.

It was also confirmed that the original image density of 0.5 could be restored after the decolored image was stored in a freezer at −20° C.

Comparative Example 1

1.5 parts of the colored fine particle dispersion, parts of the binder resin- and release agent-containing fine particle dispersion, and 83 parts of de-ionized water were mixed, and 5 parts of a 5% aluminum sulfate aqueous solution was added while stirring the mixture with a homogenizer (IKA) at 6,500 rpm. The mixture was then heated to 40° C. while being stirred at 800 rpm in a 1-L stirring vessel equipped with paddle blades. The mixture was left standing at 40° C. for 1 hour, and 10 parts of a 10% sodium polycarboxylate aqueous solution was added. The mixture was heated to 68° C., left standing for 1 hour, and cooled to obtain a blue toner dispersion.

The toner dispersion was repeatedly subjected to filtration and washing with de-ionized water until the conductivity of the filtrate became 50 μS/cm. The particles were then dried with a vacuum dryer to a water content of below 1.0 weight %, thus obtaining dry particles.

After drying, 2 parts of the same hydrophobic silica and 0.5 part of the same titanium oxide as used in Example 1 were mixed as additives with respect to 100 parts of the dry particles so as to allow these additives to attach to the dry particle surfaces. As a result, a decolorable toner was obtained. The particles had a 50% number-average diameter Dp of 7.5 μm, as measured by the same Coulter particle size distribution measurement device as used in Example 1. The coefficient of variation CV was 53%, and the particle distribution was broad because of large numbers of fine particles.

The resultant toner was mixed with a silicone resin-coated ferrite carrier, and used for image formation with the MFP (e-studio 4520c, made by Toshiba Tec) in the same manner as in Example 1. The resultant image exhibited toner fog in the non-image portion. More specifically, in the same image formation at an image density of 0.5 as in Example 1, the white background portion exhibited an image density of 0.15 higher than 0.05 of the white paper stock.

What is claimed is:

1. A method for producing a toner, comprising:

mixing a dispersion of erasable colored fine particles with an aggregating agent to form an aggregating agent-containing colored fine particle dispersion, thereby providing the erasable colored fine particles with a dispersion stability which is lower than that before the mixing with the aggregating agent; and mixing the aggregating agent-containing colored fine particle dispersion with a dispersion of fine particles comprising at least a binder resin and a release agent, thereby aggregating the aggregating agent-containing colored fine particles with the fine particles comprising at least a binder resin and a release agent.

2. The method according to claim 1, wherein the aggregating agent is a bivalent or higher metal salt.

3. The method according to claim 1, further comprising adding an additional aggregating agent to the mixture of the aggregating agent-containing colored fine particle dispersion and the dispersion of the fine particles comprising at least a binder resin and a release agent.

4. The method according to claim 1, wherein the relative amount of the aggregating agent with respect to the colored fine particles in the aggregating agent-containing colored fine particle dispersion is at least two times the relative amount of the aggregating agent with respect to the total of the colored fine particles and the fine particles comprising at least the binder resin and the release agent in the mixture of the aggregating agent-containing colored fine particle dispersion and the dispersion of fine particles comprising at least the binder resin and the release agent.

5. The method according to claim 3, wherein the relative amount of the aggregating agent with respect to the colored fine particles in the aggregating agent-containing colored fine particle dispersion is at least two times the relative amount of the aggregating agent with respect to the total of the colored fine particles and the fine particles comprising at least the binder resin and the release agent in the mixture of the aggregating agent-containing colored fine particle dispersion and the dispersion of fine particles comprising at least the binder resin and the release agent.

6. The method according to claim 1, wherein the erasable colored fine particles are each encapsulated and comprise a leuco dye, a color-developing agent, and a decoloring agent.

7. The method according to claim 6, wherein the decoloring agent is a decoloring agent with a temperature hysteresis that imparts such color characteristics to the colored fine particles that a color develops at a decoloration temperature Th higher than room temperature Tr, and that a color redevelops at a temperature lower than the room temperature Tr.

* * * * *